US010018014B2

(12) United States Patent
Radford

(10) Patent No.: US 10,018,014 B2
(45) Date of Patent: Jul. 10, 2018

(54) ACTUATION ASSEMBLIES, HYDRAULICALLY ACTUATED TOOLS FOR USE IN SUBTERRANEAN BOREHOLES INCLUDING ACTUATION ASSEMBLIES AND RELATED METHODS

(71) Applicant: Baker Hughes Incorporated, Houston, TX (US)

(72) Inventor: Steven R. Radford, South Jordan, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 15/042,623

(22) Filed: Feb. 12, 2016

(65) Prior Publication Data

US 2016/0160606 A1 Jun. 9, 2016

Related U.S. Application Data

(63) Continuation of application No. 13/784,307, filed on Mar. 4, 2013, now Pat. No. 9,284,816.

(51) Int. Cl.
*E21B 34/10* (2006.01)
*E21B 34/14* (2006.01)
(Continued)

(52) U.S. Cl.
CPC ..... *E21B 34/10* (2013.01); *E21B 10/322* (2013.01); *E21B 34/14* (2013.01); *E21B 2034/007* (2013.01)

(58) Field of Classification Search
CPC ..... E21B 34/10; E21B 34/14; E21B 10/322; E21B 2034/007
(Continued)

(56) References Cited

U.S. PATENT DOCUMENTS 1,678,075 A 7/1928 Phipps
2,069,482 A 2/1937 Seay
(Continued)

FOREIGN PATENT DOCUMENTS

AU 2973397 A 1/1998
AU 110317 B2 9/1999
(Continued)

OTHER PUBLICATIONS

International Search Report for International Application No. PCT/US2014/020211 dated Jun. 23, 2014, 4 pages.
(Continued)

*Primary Examiner* — Matthew R Buck
*Assistant Examiner* — Patrick F Lambe
(74) *Attorney, Agent, or Firm* — TraskBritt

(57) ABSTRACT

Actuation assemblies include a valve assembly comprising a valve sleeve configured to rotate to selectively enable fluid flow through at least one aperture in the valve sleeve and into at least one port of an outer sleeve and a ball retention feature configured to selectively retain a ball dropped through a fluid passageway of the valve assembly in order to rotate the valve sleeve. Downhole tools include actuation assemblies. Methods for actuating a downhole tool include receiving a ball in an actuation assembly, rotating a valve sleeve of the actuation assembly to enable fluid to flow through a portion of the actuation assembly, and actuating a portion of the downhole tool with the fluid.

18 Claims, 7 Drawing Sheets

(51) Int. Cl.
*E21B 10/32* (2006.01)
*E21B 34/00* (2006.01)

(58) Field of Classification Search
USPC ..... 166/373
See application file for complete search history.

(56) References Cited

U.S. PATENT DOCUMENTS 2,136,518 A 11/1938 Nixon
2,177,721 A 10/1939 Johnson et al.
2,344,598 A 3/1944 Church
2,532,418 A 12/1950 Page
2,638,988 A 5/1953 Williams
2,754,089 A 7/1956 Kammerer, Jr.
2,758,819 A 8/1956 Kammerer, Jr.
2,834,578 A 5/1958 Carr
2,874,784 A 2/1959 Baker, Jr. et al.
2,882,019 A 4/1959 Carr et al.
3,083,765 A 4/1963 Kammerer
3,105,562 A 10/1963 Stone et al.
3,123,162 A 3/1964 Rowley
3,126,065 A 3/1964 Chadderdon
3,171,502 A 3/1965 Kammerer
3,208,540 A 9/1965 Park
3,211,232 A 10/1965 Grimmer
3,224,507 A 12/1965 Cordary, Jr.
3,283,834 A 11/1966 Kammerer
3,289,760 A 12/1966 Kammerer
3,351,137 A 11/1967 Schulz et al.
3,425,500 A 2/1969 Fuchs
3,433,313 A 3/1969 Brown
3,472,533 A 10/1969 Turner
3,556,233 A 1/1971 Gilreath et al.
4,055,226 A 10/1977 Weber
4,231,437 A 11/1980 Swersky et al.
4,366,971 A 1/1983 Lula
4,403,659 A 9/1983 Upchurch
4,458,761 A 7/1984 Van Vreeswyk
4,545,441 A 10/1985 Williamson
4,589,504 A 5/1986 Simpson
4,660,657 A 4/1987 Furse et al.
4,690,229 A 9/1987 Raney
4,693,328 A 9/1987 Furse et al.
4,698,794 A 10/1987 Kruger et al.
4,756,372 A 7/1988 Airey
4,842,083 A 6/1989 Raney
4,848,490 A 7/1989 Anderson
4,854,403 A 8/1989 Ostertag et al.
4,856,828 A 8/1989 Kessler et al.
4,884,477 A 12/1989 Smith et al.
4,889,197 A 12/1989 Boe
4,893,678 A 1/1990 Stokley et al.
4,944,350 A 7/1990 Airey
5,065,825 A 11/1991 Bardin et al.
5,074,356 A 12/1991 Neff
5,129,689 A 7/1992 Newski et al.
5,139,098 A 8/1992 Blake
5,211,241 A 5/1993 Mashaw et al.
5,224,558 A 7/1993 Lee
5,265,684 A 11/1993 Rosenhauch
5,293,945 A 3/1994 Rosenhauch et al.
5,305,833 A 4/1994 Collins
5,318,131 A 6/1994 Baker
5,318,137 A 6/1994 Johnson et al.
5,318,138 A 6/1994 Dewey et al.
5,332,048 A 7/1994 Underwood et al.
5,343,963 A 9/1994 Bouldin et al.
5,361,859 A 11/1994 Tibbitts
5,368,114 A 11/1994 Tandberg et al.
5,375,662 A 12/1994 Echols, III et al.
5,402,856 A 4/1995 Warren et al.
5,406,983 A 4/1995 Chambers et al.
5,415,243 A 5/1995 Lyon et al.
5,425,423 A 6/1995 Dobson et al.
5,437,308 A 8/1995 Morin et al.
5,443,129 A 8/1995 Bailey et al.
5,553,678 A 9/1996 Barr et al.
5,560,440 A 10/1996 Tibbitts et al.
5,740,864 A 4/1998 de Hoedt et al.
5,765,653 A 6/1998 Doster et al.
5,788,000 A 8/1998 Maury et al.
5,823,254 A 10/1998 Dobson et al.
5,826,652 A 10/1998 Tapp
5,862,870 A 1/1999 Hutchinson et al.
5,887,655 A 3/1999 Haugen et al.
6,039,131 A 3/2000 Beaton
6,059,051 A 5/2000 Jewkes et al.
6,070,677 A 6/2000 Johnston, Jr.
6,109,354 A 8/2000 Ringgenberg et al.
6,116,336 A 9/2000 Adkins et al.
6,131,675 A 10/2000 Anderson
6,173,795 B1 1/2001 McGarian et al.
6,189,631 B1 2/2001 Sheshtawy
6,213,226 B1 4/2001 Eppink et al.
6,227,312 B1 5/2001 Eppink et al.
6,289,999 B1 9/2001 Dewey et al.
6,325,151 B1 12/2001 Vincent et al.
6,360,831 B1 3/2002 Angkesson et al.
6,378,632 B1 4/2002 Dewey et al.
6,488,104 B1 12/2002 Eppink et al.
6,494,272 B1 12/2002 Eppink et al.
6,615,933 B1 9/2003 Eddison
6,668,936 B2 12/2003 Williamson, Jr. et al.
6,668,949 B1 12/2003 Rives
6,681,860 B1 1/2004 Yokley et al.
6,702,020 B2 3/2004 Zachman et al.
6,708,785 B1 3/2004 Russell et al.
6,732,817 B2 5/2004 Dewey et al.
7,036,611 B2 5/2006 Radford et al.
7,048,078 B2 5/2006 Dewey et al.
7,252,163 B2 8/2007 Ollerenshaw et al.
7,314,099 B2 1/2008 Dewey et al.
7,513,318 B2 4/2009 Underwood et al.
7,681,666 B2 3/2010 Radford et al.
7,757,787 B2 7/2010 Mackay et al.
7,823,663 B2 11/2010 Eddison
7,900,717 B2 3/2011 Radford et al.
8,020,635 B2 9/2011 Radford
8,074,747 B2 12/2011 Radford et al.
8,118,101 B2 2/2012 Nelson et al.
8,196,679 B2 6/2012 Radford
8,230,951 B2 7/2012 Radford et al.
8,297,381 B2 10/2012 Radford et al.
8,485,282 B2 7/2013 Gentry
8,540,035 B2 9/2013 Xu et al.
8,657,039 B2 2/2014 Radford et al.
8,844,635 B2 9/2014 Oxford
8,881,833 B2 11/2014 Radford et al.
8,936,110 B2 1/2015 Adam
9,027,650 B2 5/2015 Radford et al.
2002/0070052 A1 6/2002 Armell
2003/0029644 A1 2/2003 Hoffmaster et al.
2004/0222022 A1 11/2004 Nevlud et al.
2005/0145417 A1 7/2005 Radford et al.
2006/0144623 A1 7/2006 Ollerensaw et al.
2006/0207797 A1 9/2006 Dewey et al.
2007/0089912 A1 4/2007 Eddison et al.
2008/0093080 A1 4/2008 Palmer et al.
2008/0128174 A1 6/2008 Radford et al.
2008/0128175 A1 6/2008 Radford et al.
2009/0032308 A1 2/2009 Eddison
2010/0006339 A1 1/2010 Desai
2010/0089583 A1 4/2010 Xu et al.
2010/0108394 A1 5/2010 Ollerenshaw et al.
2010/0139981 A1 6/2010 Meister et al.
2010/0193248 A1 8/2010 Radford et al.
2010/0224414 A1 9/2010 Radford et al.
2011/0005836 A1 1/2011 Radford et al.
2011/0073370 A1 3/2011 Gentry
2011/0073376 A1 3/2011 Radford et al.
2011/0127044 A1 6/2011 Radford et al.
2011/0198096 A1* 8/2011 Mailand ..... E21B 34/14 166/373
2011/0232915 A1 9/2011 Kellner et al.

(56) References Cited

U.S. PATENT DOCUMENTS

| | | | | |
|---|---|---|---|---|
| 2011/0278017 | A1 | 11/2011 | Themig et al. | |
| 2011/0284233 | A1* | 11/2011 | Wu | E21B 10/32 166/321 |
| 2012/0018173 | A1 | 1/2012 | Herberg et al. | |
| 2012/0048571 | A1 | 3/2012 | Radford et al. | |
| 2012/0055714 | A1 | 3/2012 | Adam | |
| 2012/0080183 | A1 | 4/2012 | Radford et al. | |
| 2012/0080231 | A1 | 4/2012 | Radford et al. | |
| 2012/0111574 | A1 | 5/2012 | Desranleau et al. | |
| 2012/0298422 | A1 | 11/2012 | Oxford | |
| 2013/0168099 | A1 | 7/2013 | Themig | |
| 2014/0246236 | A1 | 9/2014 | Radford et al. | |
| 2014/0246246 | A1 | 9/2014 | Radford | |

FOREIGN PATENT DOCUMENTS

| | | | |
|---|---|---|---|
| EP | 246789 | A2 | 11/1987 |
| EP | 301890 | A2 | 6/1992 |
| EP | 301890 | A3 | 6/1992 |
| EP | 301890 | B1 | 6/1992 |
| EP | 594420 | A1 | 12/1997 |
| EP | 594420 | B1 | 12/1997 |
| EP | 1036913 | A1 | 10/2002 |
| EP | 1044314 | A1 | 3/2005 |
| GB | 2328964 | A | 3/1999 |
| GB | 2344122 | A | 5/2000 |
| GB | 2344607 | A | 6/2000 |
| GB | 2344122 | B | 4/2003 |
| GB | 2385344 | A | 8/2003 |
| WO | 9747849 | A1 | 12/1997 |
| WO | 9928587 | A1 | 6/1999 |
| WO | 9928588 | A1 | 6/1999 |
| WO | 0031371 | A1 | 6/2000 |
| WO | 2004088091 | A1 | 10/2004 |
| WO | 2009132462 | A1 | 11/2009 |

OTHER PUBLICATIONS

International Written Opinion for International Application No. PCT/US2014/020211 dated Jun. 23, 2014, 11 pages.

International Preliminary Report on Patentability for International Application No. PCT/US2014/020211, dated Sep. 8, 2015, 12 pages.

* cited by examiner

ACTUATION ASSEMBLIES, HYDRAULICALLY ACTUATED TOOLS FOR USE IN SUBTERRANEAN BOREHOLES INCLUDING ACTUATION ASSEMBLIES AND RELATED METHODS

CROSS-REFERENCE TO RELATED APPLICATION

This application is a continuation of U.S. patent application Ser. No. 13/784,307, filed Mar. 4, 2013, now U.S. Pat. No. 9,284,816, issued Mar. 15, 2016, the disclosure of which is hereby incorporated herein in its entirety by this reference.

TECHNICAL FIELD

Embodiments of the present disclosure relate generally to actuation assemblies for use in a subterranean borehole and, more particularly, to actuation assemblies for hydraulically actuated downhole tools and related tools and methods.

BACKGROUND

Downhole drilling operations commonly require a downhole tool to be actuated after the tool has been deployed in the borehole. For example, expandable reamers may be employed for enlarging subterranean boreholes. Conventionally, in drilling oil, gas, and geothermal wells, casing is installed and cemented to prevent the wellbore walls from caving into the subterranean borehole while providing requisite shoring for subsequent drilling operation to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

The blades in these expandable reamers are initially retracted to permit the tool to be run through the borehole on a drill string. At a depth (e.g., once the reamer has passed beyond the end of the casing), the expandable reamer may be actuated (e.g., hydraulically actuated). Actuation of the expandable reamer will enable the blades of the expandable reamer to be extended so the bore diameter may be increased below the casing.

One hydraulic actuation methodology involves wire line retrieval of a plug through the interior of the drill string to enable differential hydraulic pressure to actuate a reamer. Upon completion of the reaming operation, the reamer may be deactivated by redeploying the dart. However, wire line actuation and deactivation are both expensive and time-consuming in that they require concurrent use of wire line assemblies.

Another hydraulic actuation methodology makes use of shear pins configured to shear at a specific differential pressure (or in a predetermine range of pressures). For example, ball drop mechanisms involve the dropping of a ball down through the drill string to a ball seat. Engagement of the ball with the seat causes an increase in differential pressure which in turn actuates the downhole tool. The tool may be deactivated by increasing the pressure beyond a predetermined threshold such that the ball and ball seat are released (e.g., via the breaking of shear pins). However, such sheer pin and ball drop mechanisms are generally one-time or one-cycle mechanisms and do not typically allow for repeated actuation and deactivation of a downhole tool.

Other actuation mechanisms may utilize measurement while drilling (MWD) systems and/or other electronically controllable systems including, for example, computer controllable solenoid valves. Electronic actuation advantageously enables a wide range of actuation and deactivation instructions to be executed and may further enable two-way communication with the surface via conventional telemetry techniques. However, these actuation systems tend to be highly complex and expensive and can be severely limited by the reliability and accuracy of MWD, telemetry, and other electronically controllable systems deployed in the borehole.

BRIEF SUMMARY

In some embodiments, the present disclosure includes actuation assemblies for use with a downhole tool in a subterranean borehole. The actuation assemblies include a valve assembly including a fluid passageway extending therethrough along a longitudinal axis of the valve assembly, an outer sleeve having at least one port formed therein, and a valve sleeve disposed within the outer sleeve. The valve sleeve has at least one aperture formed therein and is configured to rotate relative to the outer sleeve to selectively place the at least one aperture of the valve sleeve in communication with the at least one port of the outer sleeve to enable fluid flow through the at least one aperture in the valve sleeve and into the at least one port of the outer sleeve. The valve assembly further includes a ball retention feature configured to selectively retain a ball dropped through the fluid passageway of the valve assembly in order to rotate the valve sleeve.

In additional embodiments, the present disclosure includes expandable apparatus for use in a subterranean borehole. The expandable apparatus include a tubular body having a longitudinal bore and at least one opening in a wall of the tubular body and at least one member positioned within the at least one opening in the wall of the tubular body. The at least one member is configured to move between a retracted position and an extended position. The expandable apparatus further includes an actuation feature for moving the at least one member between the retracted position and the extended position and an actuation assembly coupled to the tubular body. The actuation assembly includes a valve assembly including a fluid passageway extending therethrough along a longitudinal axis of the valve assembly and at least one port formed in the valve assembly in fluid communication with a feature for actuating the at least one member. The valve assembly further includes a valve sleeve disposed within the valve assembly. The valve sleeve has at least one aperture formed therein and is configured to rotate relative to the valve assembly to selectively place the at least one aperture of the valve sleeve in communication with the at least one port of the valve assembly to enable fluid flow through the at least one aperture in the valve sleeve and the at least one port of the valve assembly to a location proximate the actuation feature.

The valve assembly further includes a ball retention feature configured to selectively retain a ball dropped through the fluid passageway of the valve assembly in order to rotate the valve sleeve.

In yet additional embodiments, the present disclosure includes methods for actuating a downhole tool. The method includes inhibiting fluid flowing through a bore of the downhole tool from flowing through at least one aperture in an actuation assembly, receiving a ball in a ball retention feature of the actuation assembly to at least partially restrict the flow of fluid through the bore, rotating a valve sleeve of the actuation assembly responsive to a force of fluid in the bore acting on the ball to enable fluid to flow through the at least one aperture in the actuation assembly and into at least one port of the actuation assembly, flowing fluid through the at least one port to move an actuation member connected to a downhole tool, and actuating a portion of the downhole tool responsive to movement of the actuation member.

BRIEF DESCRIPTION OF THE DRAWINGS

While the specification concludes with claims particularly pointing out and distinctly claiming what are regarded as embodiments of the disclosure, various features and advantages of embodiments of the disclosure may be more readily ascertained from the following description of some embodiments of the disclosure, when read in conjunction with the accompanying drawings, in which:

DETAILED DESCRIPTION

The illustrations presented herein are, in some instances, not actual views of any particular tool, apparatus, structure, element, or other feature of a downhole or earth-boring tool, but are merely idealized representations that are employed to describe embodiments of the present disclosure. Additionally, elements common between figures may retain the same numerical designation.

Although embodiments of the present disclosure are depicted as being used and employed in a reamer such as an expandable reamer, persons of ordinary skill in the art will understand that the embodiments of the present disclosure may be employed in any downhole tool where use of hydraulic actuation including a ball drop feature is desirable. For example, embodiments of the actuation assemblies disclosed herein may be utilized with various downhole tools including actuation assemblies such as downhole tools for use in casing operations, downhole tools for use in directional drilling, stabilizer assemblies, hydraulic disconnects, downhole valves, packers, bridge plugs, hydraulic setting tools, circulating subs, crossover tools, pressure firing heads, coring tools, liner setting tools, whipstock setting tools, anchors, etc.

In some embodiments, the actuation assemblies disclosed herein may be utilized with expandable reamers similar to those described in, for example, U.S. Pat. No. 7,900,717, entitled "Expandable Reamers for Earth-Boring Applications," issued Mar. 8, 2011 and U.S. patent application Ser. No. 13/784,284, filed on even date herewith and titled "Expandable Reamer Assemblies, Bottom Hole Assemblies, and Related Methods," the disclosure of each of which is incorporated herein in its entirety by this reference.

Figure 1:
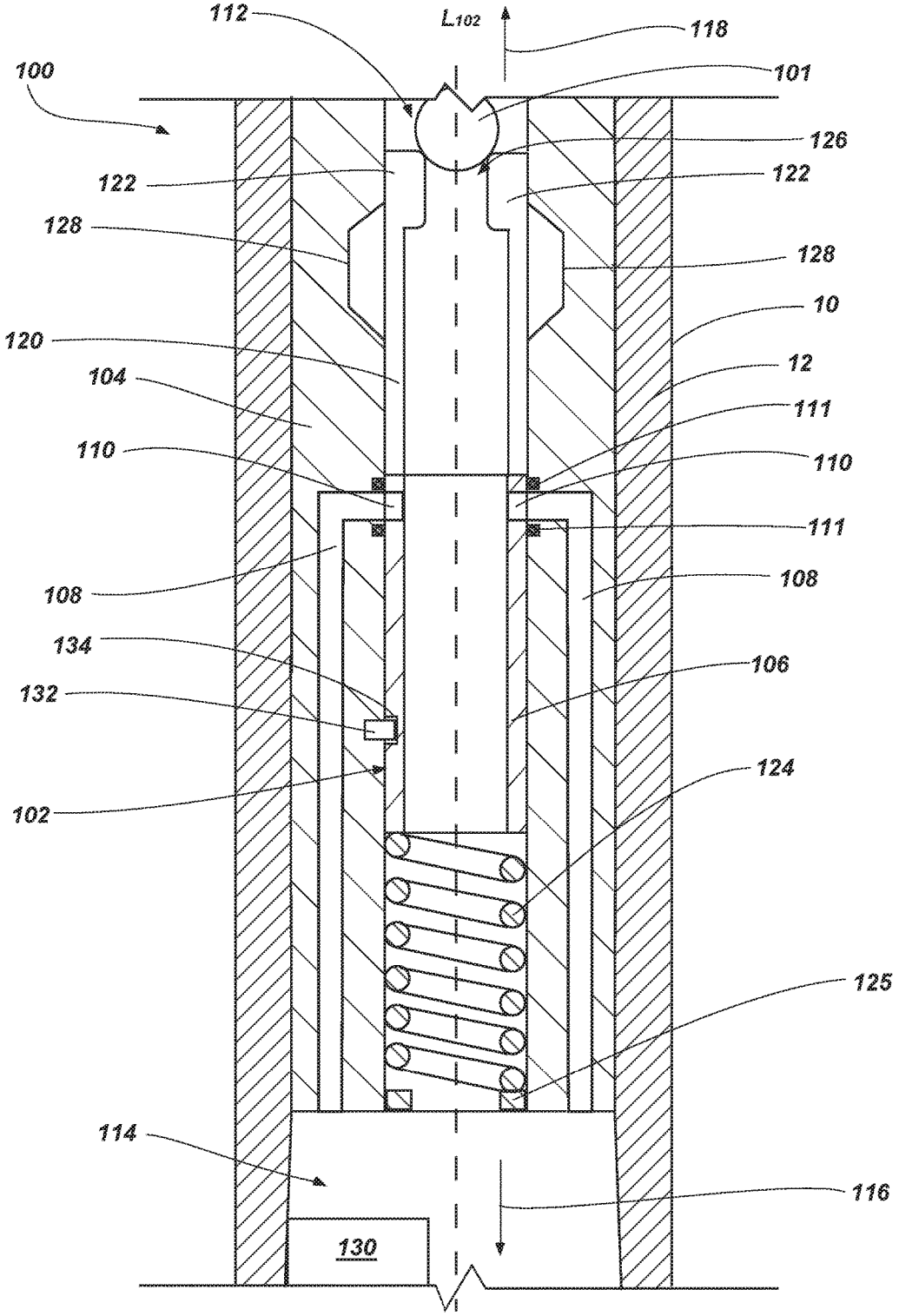
FIG. 1 is a partial cross-sectional view of an actuation assembly in accordance with an embodiment of the present disclosure shown in an open position.

FIG. 1 is a cross-sectional view of an actuation assembly (e.g., hydraulic actuation assembly 100) shown in an open position. As shown in FIG. 1, the actuation assembly 100 includes a valve assembly 102 configured to open or to close in response to one or more mechanical forces. For example, the valve assembly 102 may comprise an outer sleeve 104 disposed within a body 12 (e.g., a tubular body) of a downhole assembly 10. In some embodiments, the downhole assembly 10 may comprise an actuation sub in a drill string. For example, as described in the above-referenced U.S. patent application Ser. No. 13/784,284, the actuation sub including the actuation assembly 100 may be positioned adjacent (e.g., directly adjacent) to a downhole tool (e.g., an expandable reamer) and may act to actuate the downhole tool. In other, embodiments, the downhole assembly 10 may comprise a downhole tool (e.g., an expandable reamer) where the actuation assembly 100 is formed integral with the downhole tool and may be utilized to actuate the downhole tool.

It is noted that while the outer sleeve 104 is shown in FIG. 1 as being separate from the tubular body 12 of the downhole assembly 10, in other embodiments, the outer sleeve 104 may be part of (e.g., may be integral with) the body of a downhole tool.

The valve assembly 102 includes a member (e.g., valve sleeve 106) that is disposed within the outer sleeve 104 and configured to selectively expose one or more valve ports 108 in the outer sleeve 104 via one or more apertures 110 in the valve sleeve 106, through which a fluid may flow between a fluid passageway 112 extending through the body 12 and the outer sleeve 104 and another portion of the downhole assembly 10 (e.g., an annular chamber 114 positioned in a downhole direction 116 from the valve assembly 102).

As used herein, the terms downhole and uphole are used to indicate various directions and portions of the actuation assembly in the orientation in which it is intended to be used in a borehole.

Figure 3:
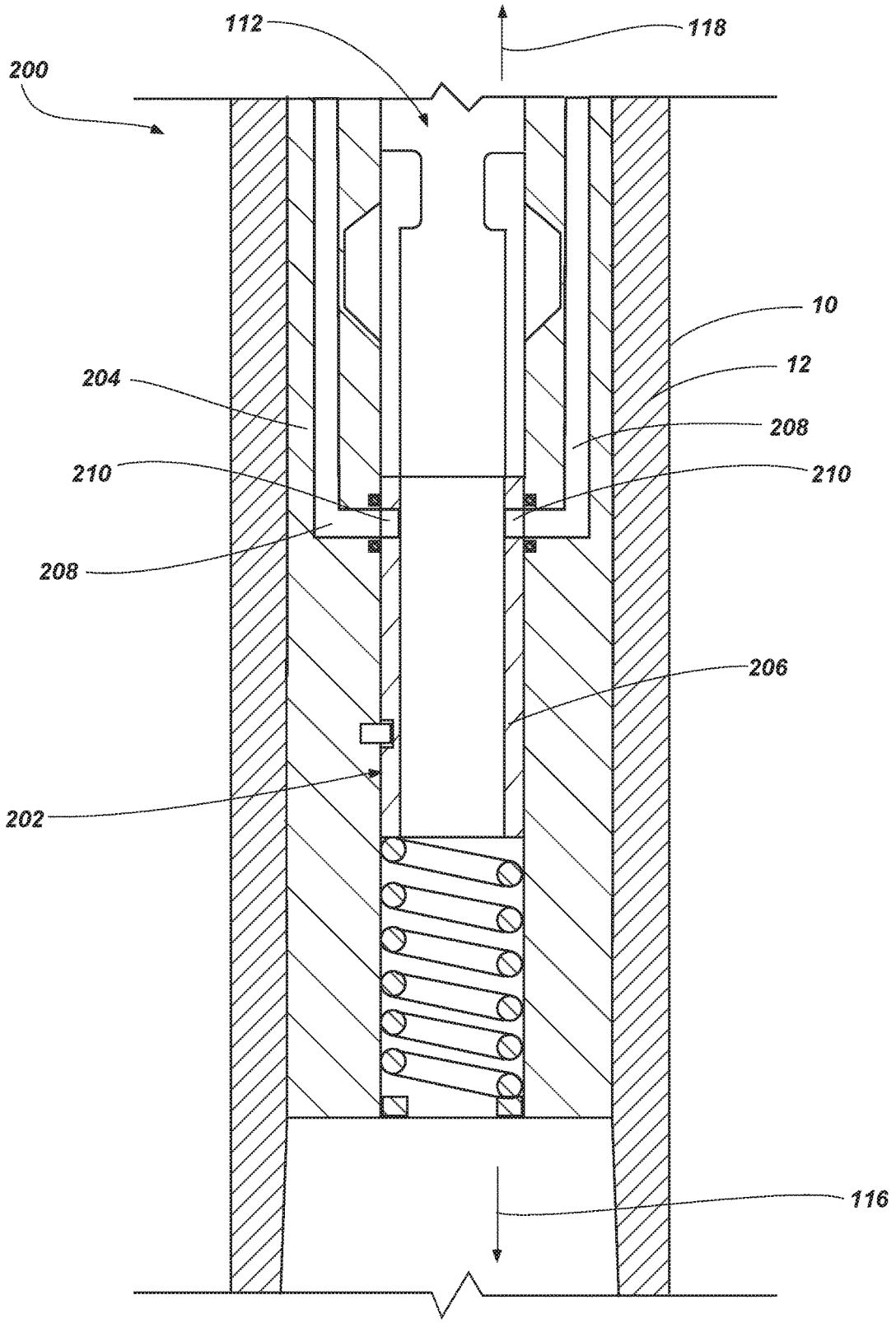
FIG. 3 is a partial cross-sectional view of an actuation assembly in accordance with another embodiment of the present disclosure shown in an open position.

In other embodiments, and as shown in FIG. 3, actuation assembly 200 includes a valve assembly 202 having a valve sleeve 206 and an outer sleeve 204. The outer sleeve 204 and the valve sleeve 206 may be configured to selectively expose one or more valve ports 208 via one or more apertures 210 in the valve sleeve 204, through which a fluid may flow between the fluid passageway 112 extending through the body 12 and the outer sleeve 204 and another portion of the downhole assembly 10 in an uphole direction 118 from the valve assembly 202.

In yet other embodiments, the actuation assembly may include one or more longitudinally offset valve ports 208 to selectively direct fluid in both an uphole and downhole direction through selective longitudinal and circumferential alignment of one or more apertures 210 in valve sleeve 206 in accordance with the detailed description set forth below with regard to FIG. 5.

Referring back to FIG. 1, the valve sleeve 106 is configured to selectively place the fluid passageway 112 in fluid communication with the ports 108 in the outer sleeve 104 by moving the apertures 110 of the valve sleeve 106 into and out of alignment with the ports 108 in the outer sleeve 104. For example, as shown in FIG. 1, the valve assembly 102 is shown in the open position where the apertures 110 of the valve sleeve 106 are at least substantially aligned with the ports 108 in the outer sleeve 104 such that fluid traveling through the fluid passageway 112 may pass through the apertures 110 into the ports 108 and through the ports 108 to another portion of the drill string (e.g., another portion of the downhole assembly 10). In some embodiments, the fluid may travel further through various portions of the drill string as desired.

The actuation assembly may include one or more seals 111 positioned about the valve sleeve 106 on opposing sides of the ports 108. For example, the seals 111 may be positioned (e.g., in the outer sleeve 104) between the movable valve sleeve 106 and the fixed outer sleeve 104 to at least substantially prevent fluid from traveling between the movable valve sleeve 106 and the fixed outer sleeve 104, which may enable fluid to unintentionally access the ports 108 when the actuation assembly 100 is in a closed position (see FIG. 2). In some embodiments, the seals 111 may include D-seals, chevron seal stacks, etc., and may comprise materials such as, for example, hydrogenated nitrile butadiene rubber (HNBR), TEFLON®, composites, KEVLAR®, polyether ether ketone (PEEK™), plastics, compositions of rubber, polymers, graphite, etc.

Figure 2:
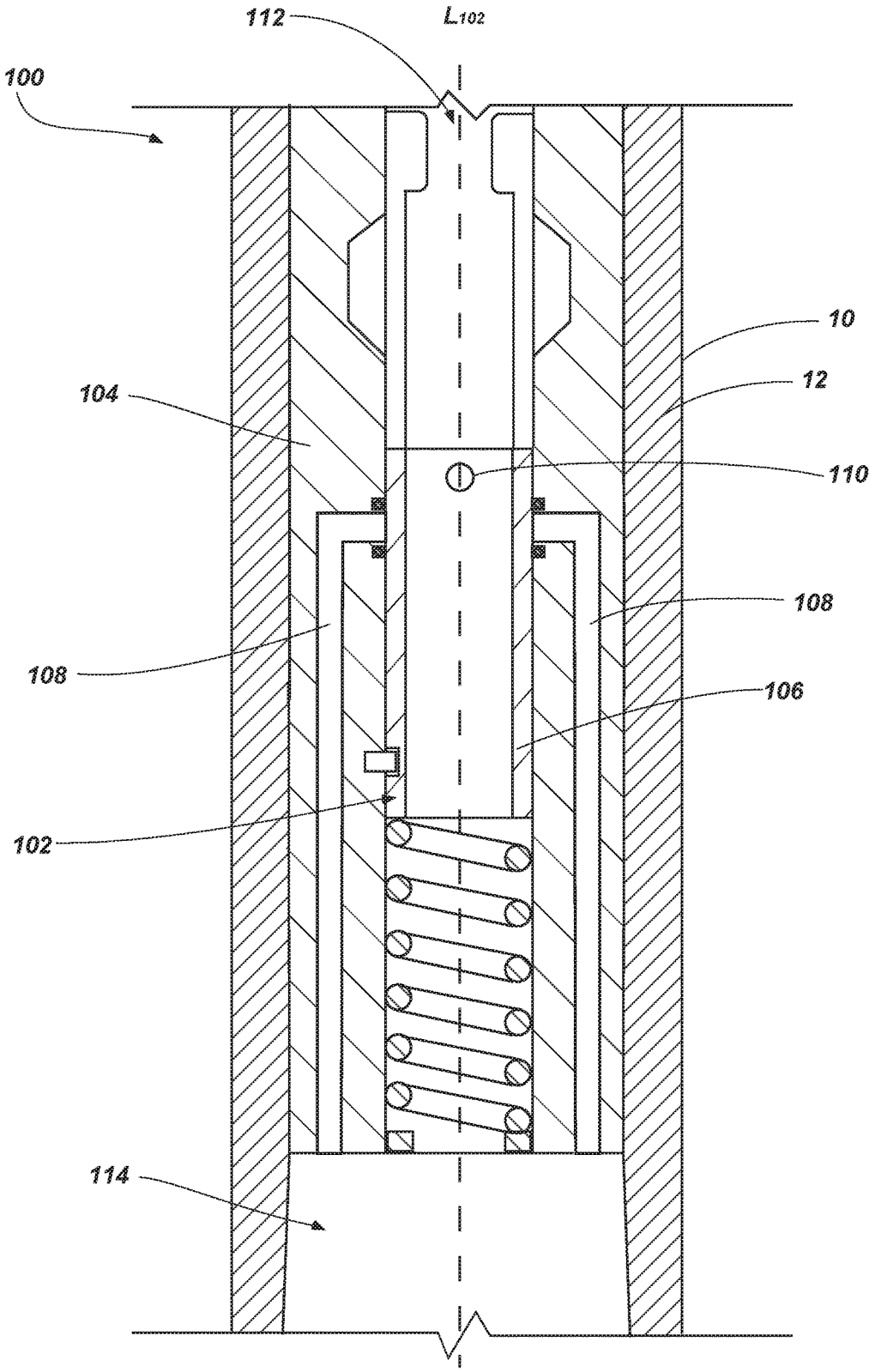
FIG. 2 is a partial cross-sectional view of the actuation assembly of FIG. 1 shown in a closed position.

FIG. 2 is a cross-sectional view of the actuation assembly 100 where the valve assembly 102 is shown in a closed position where the apertures 110 of the valve sleeve 106 are not aligned with ports 108 in the outer sleeve 104 such that fluid traveling through the fluid passageway 112 is at least substantially isolated from the ports 108 of the outer sleeve 104. Stated in another way, the fluid passageway 112 is at least substantially isolated from the annular chamber 114.

As mentioned above, the valve sleeve 106 may be configured to move the one or more apertures 110 of the valve sleeve 106 into and out of communication with the ports 108 of the outer sleeve 104. For example, the valve sleeve 106 may be configured to rotationally move about a longitudinal axis $L_{102}$ of the valve assembly 102 (e.g., along the circumference of the valve sleeve 106), to axially move (e.g., translate) along the longitudinal axis $L_{102}$ of the valve assembly 102 (e.g., along the length of the valve sleeve 106), or combinations thereof As depicted, the valve sleeve 106 may be moved both axially and rotationally (e.g., by a pin and slot configuration as discussed in greater detail below) to move in and out of communication with the ports 108 of the outer sleeve 104. In other embodiments, the valve sleeve 106 may be moved by only one of rotational movement and axial movement of the valve sleeve 106 to move in and out of communication with the ports 108 of the outer sleeve 104.

It is noted that while the embodiment of FIGS. 1 and 2 illustrates two apertures 110 in the valve sleeve 106 that move in and out of communication with the ports 108, in other embodiments, the valve sleeve 106 may include any number of circumferentially spaced apertures 110 therein or apertures connected by circumferential grooves that may be moved in and out of communication with a similar or dissimilar number of circumferentially spaced ports 108 in the outer sleeve 104.

Referring back to FIG. 1, in order to move the apertures 110 of the valve sleeve 106 in and out of communication with the ports 108 of the outer sleeve 104, the valve assembly 102 may include an uphole portion (e.g., an uphole portion 120 of the valve sleeve 106) for receiving a ball 101 dropped through the drill string to the valve assembly 102. In some embodiments, the ball 101 may comprise one or more materials such as, for example, metals, polymers, ceramics, glass, fiberglass, dissolvable materials, nanomaterials, etc. The uphole portion 120 of the valve sleeve 106 may form a ball retention feature configured to selectively retain the ball 101 (e.g., at least temporarily) such that force from fluid traveling through the fluid passageway 112 acts on the ball 101 and, in some embodiments, the uphole portion 120 of the valve sleeve 106 to force the valve sleeve 106 in the downhole direction 116. In some embodiments, the force from the fluid traveling through the fluid passageway 112 may force the valve sleeve 106 in the downhole direction 116 against a biasing force (e.g., a spring 124 that is retained in the outer sleeve 104 with a retaining ring 125).

In some embodiments, the uphole portion 120 of the valve sleeve 106 may comprise a collet 122 that forms a restriction in the fluid passageway 112 (e.g., a reduced diameter) in order to form a seat 126 for a ball 101 dropped through the fluid passageway 112. In some embodiments, the restriction fondled by the collet 122 may be large enough and/or the biasing force of the spring 124 is strong enough that force from fluid flowing therethrough does not move the valve sleeve 106 in the downhole direction 116 without a ball 101 being received in the seat 126. For example, one or more of the collet 122 and the spring 124 may be selected to retain the valve sleeve 106 in a first, uphole position as shown in FIG. 1 when fluid is flowing through the fluid passageway 112 and through the restriction formed by the collet 122 and may further be selected to enable the collet 122 to move against the biasing force of the spring 124 when the ball 101 is received in the collet 122.

Figure 4:
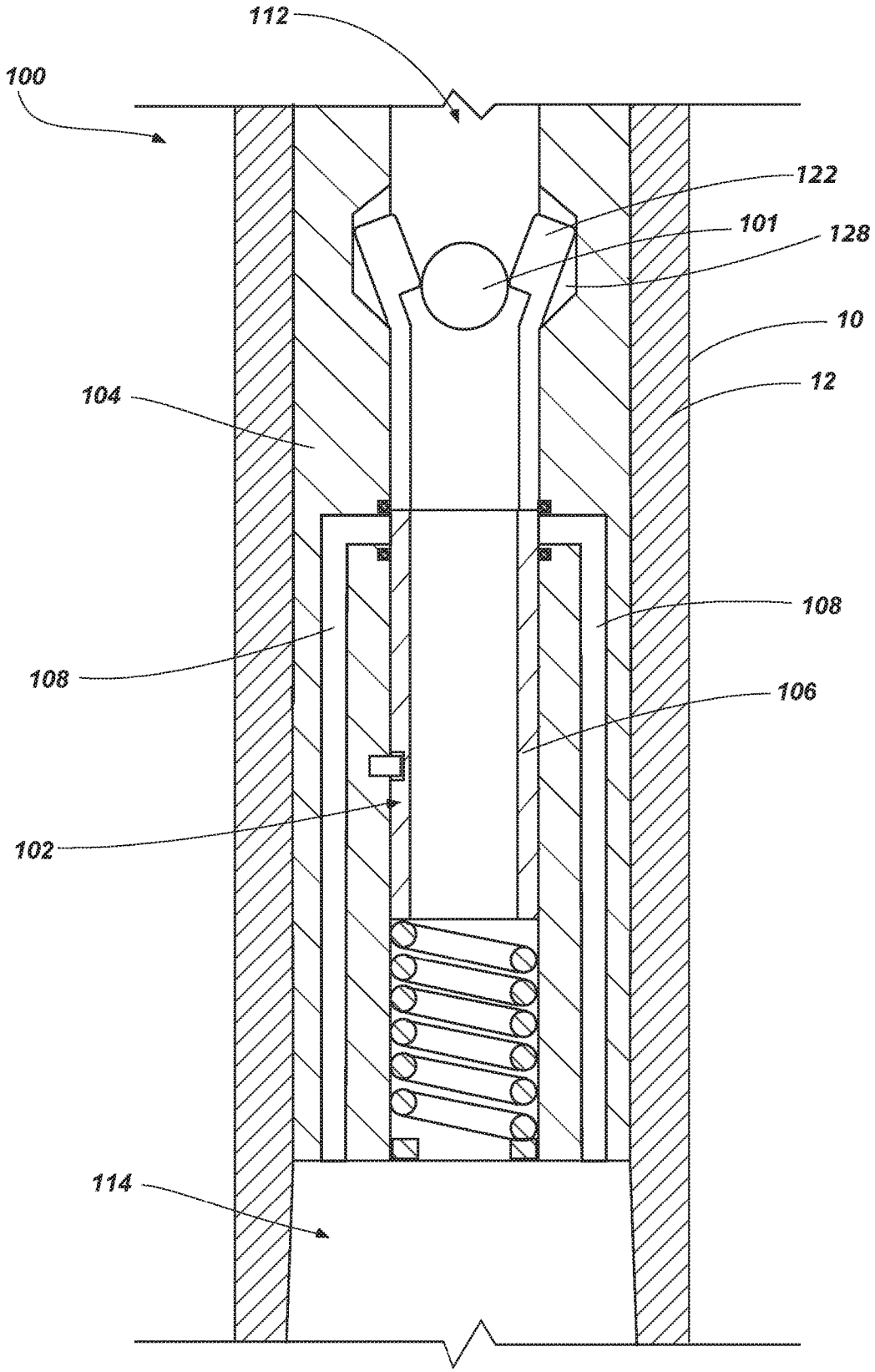
FIG. 4 is a partial cross-sectional view of the actuation assembly of FIG. 1 shown with a valve sleeve in a downhole position.

A portion of the actuation assembly 100 (e.g., outer sleeve 104) may include a feature enabling the ball 101 to pass through the collet 122 and continue in the downhole direction 116. For example, the outer sleeve 104 may include one or more recesses 128 that may enable the collet 122 to expand (e.g., to an enlarged diameter) and allow the ball 101 to pass therethrough. As shown in FIG. 4, translation of the valve sleeve 106 in the downhole direction 116 from an initial, uphole position to a downhole position enables a portion of the collet 122 to expand into the recesses 128. Expansion of the collet 122 into the recesses 128 increases the size (e.g., diameter) of the restriction formed by the collet 122 enabling the ball 101 to pass through the collet 128 and continue in the downhole direction 116.

After the ball 101 has been released from the collet 122, the collet 122 may retract to its initial, smaller outer diameter and the biasing force of the spring 124 may return the valve sleeve 106 to the uphole position. The translation of the valve sleeve 106 between the uphole position and the downhole position with the forces supplied to the valve sleeve 106 with the collet 122 having a ball 101 received therein and the spring 124 may act to transition the apertures 110 of the valve sleeve 106 into and out of communication with the ports 108 as shown in FIGS. 1 and 2.

In other embodiments, the uphole portion 120 of the valve sleeve 106 may be formed in any suitable configuration that provides a seat for the ball 101 that is variable in at least one of size and shape to enable the ball 101 to be released from the seat as desired. For example, the uphole portion 120 of the valve sleeve 106 may comprise one or more inwardly resiliently biased sliding dogs formed in apertures in the uphole portion 120 of the valve sleeve 106. In a first reduced diameter position, the dogs may retain the ball 101 and may enable the ball 101 to pass therethrough in a second, enlarged diameter position (e.g., where the dogs are able to enlarge the diameter of the seat by sliding into recesses 128 formed in the outer sleeve 104) against the initial bias. Following release of the ball 101 the bias returns the dogs to an initial position, releasing the valve sleeve 106 to enable spring 124 to return the valve sleeve 106 to an uphole position.

In yet other embodiments, the uphole portion 120 of the valve sleeve 106 may comprise a deformable ball seat (e.g., comprising a rubber and/or polymer) on the uphole portion 120 of the valve sleeve 106. The deformable ball seat may provide a first reduced diameter position that may retain the ball 101. The deformable ball seat may retain the ball 101 as fluid flow forces the valve sleeve 106 in the downhole direction 116. Under a selected amount of fluid force (e.g., after the spring has been 124 compressed), the deformable ball seat may deform to enable the ball 101 to pass therethrough enabling the valve sleeve 106 to return to its initial position in the uphole direction 118.

In some embodiments, a portion of the drill sting (e.g., the actuation assembly 100 or another portion of the drill string) may include one or more ball retention features 130 that retain the ball 101 after the ball 101 has been released from the collet 122 and has passed through the valve sleeve 106. For example, the actuation assembly 100 may include or be utilized with the ball catcher disclosed in U.S. Pat. No. 8,118,101, entitled "Ball Catcher with Retention Capability," issued Feb. 21, 2012, the disclosure of which is incorporated herein in its entirety by this reference.

As mentioned above, and in some embodiments, the valve sleeve 106 may be coupled with and move relative to the outer sleeve 104 with one or more pins 132 and a pin track 134 configuration. For example, the valve sleeve 106 may include a pin track 134 formed in an outer surface thereof and configured to receive one or more pins 132 on an inner surface of the outer sleeve 104. In other embodiments, the valve sleeve 106 may comprise one or more pins on the outer surface thereof and the outer sleeve 104 may comprise a pin track formed in an inner surface for receiving the one or more pins of the valve sleeve 106.

Figure 5:
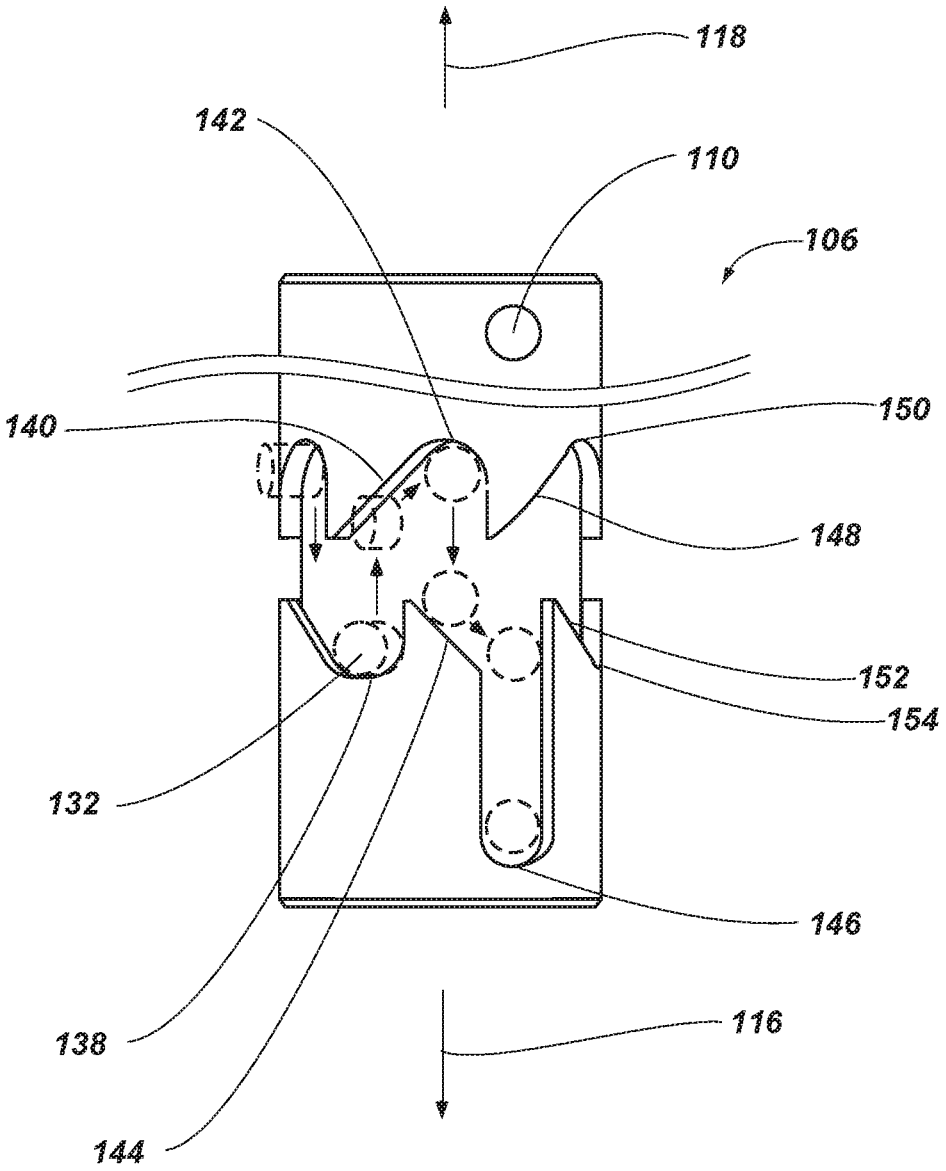
FIG. 5 is a front view of a lower portion of a valve sleeve in accordance with at least one embodiment of the present disclosure.

FIG. 5 illustrates a lower portion of a valve sleeve (e.g., valve sleeve 106) in accordance with at least one embodiment of the present disclosure that includes the pin track 134 formed in the outer surface 136 of the valve sleeve 106 in which the pin track 134 comprises a J-slot configuration. As shown in FIG. 5, the valve sleeve 106 may be biased (e.g., by the spring 124 (FIG. 1)) in the uphole direction 118. Several exemplary positions of the pin 132 carried by the outer sleeve 104 (FIG. 1) are shown in dotted lines received by the pin track 134. Referring also to FIGS. 1 and 4, the valve sleeve 106 is longitudinally and rotationally guided by the engagement of the pin 132 with the pin track 134 when the valve sleeve 106 is moved in the downhole and uphole directions 116, 118 (e.g., in the uphole direction 118 by the force of the spring 124 and in the downhole direction 116 by the force of fluid on the ball 101 received in the collet 122).

For example, when there is no ball received in the collet 122, which enables fluid to pass through the valve sleeve 106, the force exerted by the spring 124 biases the valve sleeve 106 in the uphole direction 118 and the pin 132 rests in a first lower hooked portion 138 of the pin track 134. When a ball 101 is received in the collet 122, drilling fluid flowing through the fluid passageway 112 at a sufficient flow rate may overcome the force exerted by spring 124 and force the valve sleeve 106 in the downhole direction 116. As the valve sleeve 106 is forced in the downhole direction 116, the pin track 134 moves along pin 132 until pin 132 comes into contact with the upper angled sidewall 140 of the pin track 134. Movement of the valve sleeve 106 continues as pin 132 is engaged by the upper angled sidewall 140 until the pin 132 sits in a first upper hooked portion 142. As the upper angled sidewall 140 of the pin track 134 is engaged by pin 132, the valve sleeve 106 is forced to rotate, assuming the outer sleeve 104 to which the pin 132 is attached is fixed within the valve assembly 102.

As discussed above, as the valve sleeve 106 moves in the downhole direction 116, the collet 122 may release the ball 101 enabling the fluid to flow through the valve sleeve 106 again and enabling the biasing force of the spring 124 to return the valve sleeve 106 to an initial position in the uphole direction 118. As the valve sleeve 106 is forced in the uphole direction 118 by the spring 124, the pin track 134 moves along pin 132 until pin 132 comes into contact with a lower angled sidewall 144 of the pin track 134. Movement of the valve sleeve 106 continues as pin 132 is engaged by the lower angled sidewall 144 until the pin 132 sits in a second lower hooked portion 146 of the pin track 134. As the lower angled sidewall 144 of the pin track 134 is engaged by pin 132, the valve sleeve 106 is forced to rotate and to move in the uphole direction 118 as the pin 132 is received in the second lower hooked portion 146 that enables the valve sleeve 106 to be forced a furthest position in the uphole direction 118 that the valve sleeve 106 is capable of moving with the pin 132 and pin track 134. The rotation and translation of the valve sleeve 106 may cause the apertures 110 in the valve sleeve 106 to move into alignment with the valve ports 108 in communication with the annular chamber 114, enabling drilling fluid from inside the valve assembly 102 to flow to the annular chamber 114.

When another ball 101 is received in the collet 122, drilling fluid flowing through the fluid passageway 112 at a sufficient flow rate may again overcome the force exerted by spring 124 and force the valve sleeve 106 in the downhole direction 116. As the valve sleeve 106 is forced in the downhole direction 116, the pin track 134 moves along pin 132 until pin 132 comes into contact with another upper angled sidewall 148 (e.g., that may be similar to the upper angled sidewall 140) of the pin track 134. Movement of the valve sleeve 106 continues as pin 132 is engaged by the upper angled sidewall 148 until the pin 132 sits in a second upper hooked portion 150 (e.g., that may be similar to the first upper hooked portion 142). As the upper angled sidewall 148 of the pin track 134 is engaged by pin 132, the valve sleeve 106 is forced to rotate.

As above, as the valve sleeve 106 moves in the downhole direction 116, the collet 122 may release the ball 101 enabling the fluid to flow through the valve sleeve 106 again and enabling the biasing force of the spring 124 to return the valve sleeve 106 to an initial position in the uphole direction 118. As the valve sleeve 106 is forced in the uphole direction 118 by the spring 124, the pin track 134 moves along pin 132 until pin 132 comes into contact with a lower angled sidewall 152 (e.g., that may be similar to the lower angled sidewall 144) of the pin track 134. Movement of the valve sleeve 106 continues as pin 132 is engaged by the lower angled sidewall 152 until the pin 132 sits in a third lower hooked portion 154 (e.g., that may be similar to the first lower hooked portion 138) of the pin track 134. As the lower angled sidewall 152 of the pin track 134 is engaged by pin 132, the valve sleeve 106 is forced to rotate and to move in the uphole direction 118 as the pin 132 is received in the third lower hooked portion 154. The rotation and translation of the valve sleeve 106 may cause the apertures 110 in the valve sleeve 106 to move out of alignment with the valve ports 108 in communication with the annular chamber 114, inhibiting flow of the drilling fluid from inside the valve assembly 102 to the annular chamber 114.

Rotation and translation of the valve sleeve 106 by the pin 132 and pin track 134 may repeatedly continue in the above manner about the circumference of the valve sleeve 106 to move the apertures 110 of the valve sleeve 106 into and out of alignment with one or more valve ports 108 as shown in FIGS. 1 and 2. In other words, balls 101 may be repeatedly dropped through the actuation assembly 100 to repeatedly activate and deactivate a downhole tool that is utilized with the actuation assembly 100.

Figure 6:
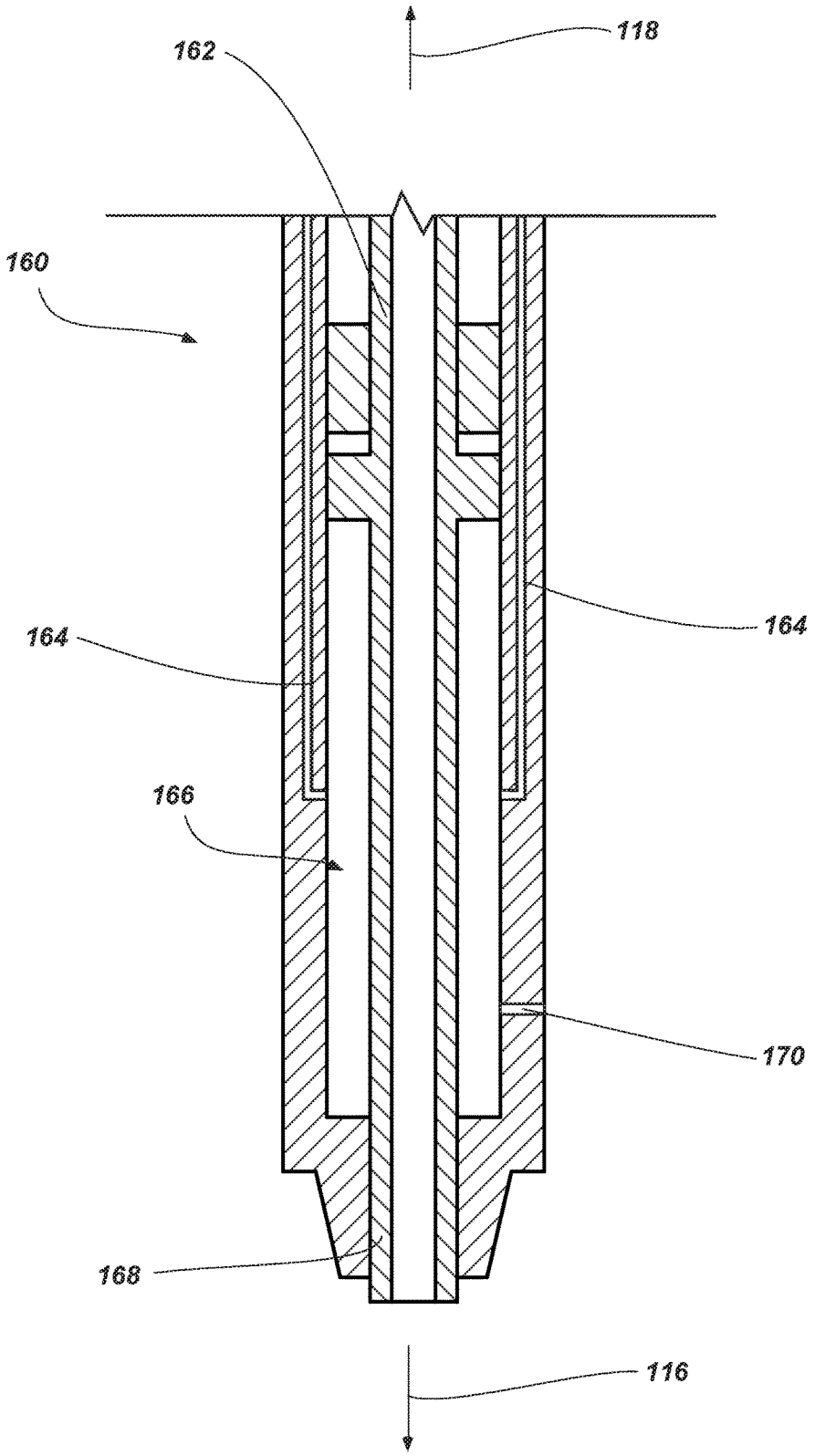
FIG. 6 is a cross-sectional view of a piston assembly that may be utilized with an actuation assembly such as the actuation assembly shown in FIG. 1 in accordance with an embodiment of the present disclosure.

FIG. 6 is a partial cross-sectional view of a piston assembly 160 that may be utilized with an actuation assembly such as the actuation assembly 100 shown in FIG. 1. As shown in FIG. 6, fluid supplied to the piston assembly 160 through the ports 108 of the actuation assembly 100 (FIG. 1) may act to force a piston 162 of the piston assembly 160 in the uphole direction 118. In other embodiments, the actuation assembly (e.g., actuation assemblies 100, 200 as shown in FIGS. 1 and 2) may act to force a piston in the downhole direction 116. In order to force the piston 162 in the uphole direction 118, the piston assembly 160 may include one or more ports 164 for directing fluid to a downhole side of the piston 162 such that pressure from the buildup of fluid in a chamber 166 may force the piston 162 in the uphole direction 118. As noted above, an actuation assembly may be configured to selectively provide pressure to each of an uphole and a downhole side of the piston 162 to provide positive actuation in both longitudinal directions.

Figure 7:
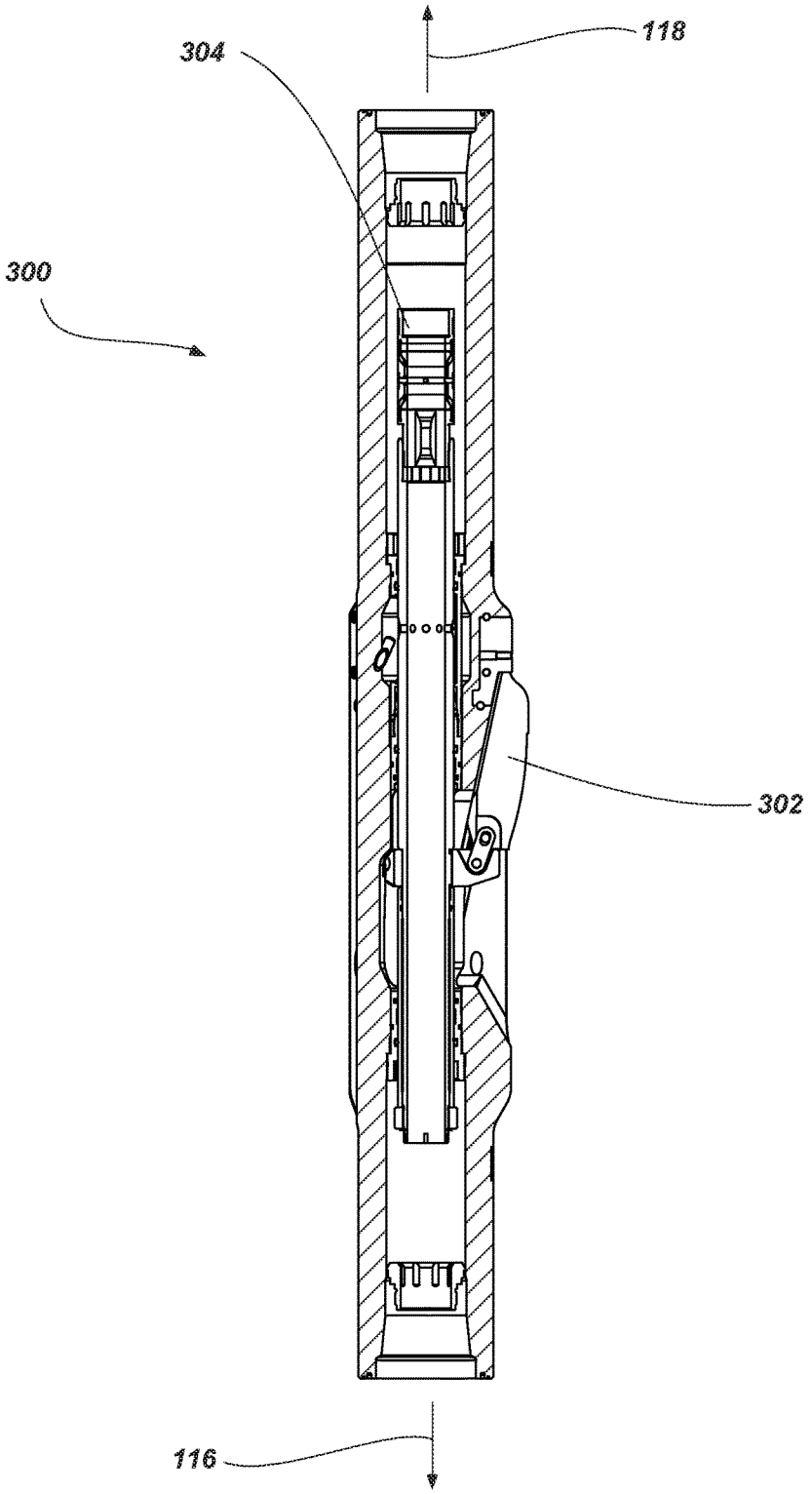
FIG. 7 is a partial cross-sectional view of an expandable apparatus that may be utilized with an actuation assembly such as the actuation assembly shown in FIG. 1 in accordance with an embodiment of the present disclosure.

A connection portion 168 of the piston 162 may be directly or indirectly coupled to a portion of a downhole tool that is capable of being actuated by longitudinal movement of an actuation member connected thereto. For example, one embodiment of a downhole tool such as an expandable apparatus 300 is shown in FIG. 7. The expandable apparatus 300 may include one or more blades 302 configured as one or more reamer blades having cutting elements thereon for enlarging a borehole and stabilizing blades for stabilizing at least a portion of a drill string during a downhole operation. As discussed above, in some embodiments, the expandable apparatus 300 may be substantially similar to that disclosed in U.S. patent application Ser. No. 13/784,284. Referring to FIGS. 6 and 7, connection portion 168 of the piston 162 may be coupled to an actuation sleeve 304 of the expandable apparatus 300 that is coupled to the blades 302. In such an embodiment, when the actuation assembly 100 (FIG. 1) provides fluid to the piston assembly 160 to actuate the piston 162 in the uphole direction 118, translation of the piston 162 in the uphole direction 118 will act to expand the blades 302 of the expandable apparatus 300 (e.g., to ream a borehole).

In some embodiments, a piston assembly similar to the piston assembly 160 shown in FIG. 6 may be utilized with an actuation assembly such as the actuation assembly 200 shown in FIG. 3 positioned in the downhole direction 116 from the piston assembly 160. In such an embodiment, the piston 162 may be forced in the uphole direction 118 by fluid passing from the valve assembly 202 through the ports 208 in the uphole direction 118 through one or more ports (not shown) formed in a downhole portion of the piston assembly 160 and into chamber 166. As above, a connection portion of the piston 162 may be directly or indirectly coupled to a portion of a downhole tool that is capable of being actuated by longitudinal movement of an actuation member (e.g., one or more reamer blades of an expandable reamer).

In some embodiments, the piston assembly 160 may include a bleed valve 170 that enables fluid in the chamber 166 to pass therethrough, for example, to another portion of the drill string (e.g., to another portion of the piston assembly 160), to the exterior of the drill string (e.g., to the exterior of the piston assembly 160), or combinations thereof. In some embodiments, the bleed valve 170 may be constantly open. For example, the bleed valve 170 may be sized and configured to enable actuation of the piston 162 when the actuation assembly 100 (FIG. 1) provides fluid to the piston assembly 160. When the actuation assembly 100 (FIG. 1) does not provide fluid to the piston assembly 160, the bleed valve 170 may release the fluid in the chamber 166 such that the piston 162 may return to a deactivated position.

In some embodiments, fluid supplied through an actuation assembly such as the actuation assembly 200 shown in FIG. 2 may act to directly force an actuation structure of a downhole tool without the use of a piston assembly. For example, fluid supplied through the actuation assembly 200 may act on the push sleeve of an expandable apparatus such as that described in the above-referenced U.S. Pat. No. 7,900,717.

While particular embodiments of the disclosure have been shown and described, numerous variations and other embodiments will occur to those skilled in the art. Accordingly, it is intended that the disclosure only be limited in terms of the appended claims and their legal equivalents.

What is claimed is:

1. An actuation assembly for actuating a downhole tool, comprising:

a body having at least one port in the body, the at least one port in communication with a location proximate a fluid-actuated feature of the downhole tool, the body further having a fluid passageway extending through the body, the at least one port extending through the body along a lateral side portion in one of a downhole direction or an uphole direction and configured to deliver fluid to the fluid-actuated feature of the downhole tool for actuating the downhole tool; and a valve sleeve disposed within the body, the valve sleeve having at least one aperture through a wall of the valve sleeve in fluid communication with the fluid passageway, the valve sleeve configured to move relative to the body to selectively place the at least one aperture of the valve sleeve in communication with the at least one port of the body to enable fluid flow through the at least one aperture in the wall of the valve sleeve and into the at least one port of the body, the valve sleeve comprising an actuator element retention feature configured to move the valve sleeve in response to fluid flow through the fluid passageway, the actuator element retention feature configured, in at least a first position, to selectively retain an actuator element dropped through the fluid passageway of the body in order to move the valve sleeve in response to fluid flow through the fluid passageway and, in a second position, configured to release the actuator element back into the fluid passageway in the downhole direction.

2. The actuation assembly of claim 1, wherein the fluid-actuated feature of the downhole tool comprises a piston assembly in fluid communication with the at least one port of the body.

3. The actuation assembly of claim 2, wherein the piston assembly comprises a chamber positioned adjacent to a piston within the piston assembly, the piston configured to move in an uphole direction responsive to fluid pressure in the chamber.

4. The actuation assembly of claim 1, wherein the actuator element retention feature of the valve sleeve is configured to move the valve sleeve in the downhole direction.

5. The actuation assembly of claim 4, wherein the valve sleeve is biased in an uphole direction.

6. The actuation assembly of claim 1, wherein, in a first position, the at least one aperture in the wall of the valve sleeve is in communication with the at least one port of the body to enable fluid to flow through the at least one aperture in the wall of the valve sleeve and into the at least one port of the body, and wherein, in a second position, the at least one aperture of the valve sleeve is positioned away from the at least one port of the body to inhibit fluid from flowing through the at least one aperture in the wall of the valve sleeve into the at least one port of the body.

7. The actuation assembly of claim 1, wherein the valve sleeve is configured to rotate and translate relative to the body to selectively place the at least one aperture of the valve sleeve in communication with the at least one port of the body.

8. An expandable apparatus for use in a subterranean borehole, comprising:

a body having a longitudinal bore and at least one opening in a wall of the body;

at least one member positioned within the at least one opening in the body, the at least one member configured to move between a retracted position and an extended position; and an actuation assembly coupled to the body, the actuation assembly comprising:

a fluid passageway extending through the actuation assembly;

at least one actuation fluid pathway in the actuation assembly associated with the at least one member, the at least one actuation fluid pathway extending through the body along a sidewall of the body in one of an uphole direction or a downhole direction; and a movable member disposed within the actuation assembly having at least one aperture in the movable member and an actuator element retention feature configured to selectively retain an actuator element dropped through the fluid passageway of the actuation assembly in order to displace the movable member, the movable member configured to be repeatedly displaced relative to the at least one actuation fluid pathway by the actuator element retention feature to selectively place the at least one aperture of the movable member in fluid communication with the at least one actuation fluid pathway to enable fluid flow to travel from the fluid passageway through the at least one aperture in the movable member and through the at least one actuation fluid pathway extending through the body in order to move the at least one member to the extended position.

9. The expandable apparatus of claim 8, wherein the actuator element retention feature is configured to release the actuator element comprising a ball after retaining the ball for a selected period of time.

10. The expandable apparatus of claim 9, wherein displacement of the movable member in a downhole direction is configured to enable the actuator element retention feature to expand and to release the ball after retaining the ball for the selected period of time.

11. The expandable apparatus of claim 8, wherein the movable member is configured to displace relative to the at least one actuation fluid pathway responsive to force applied to the movable member by fluid flow through the fluid passageway.

12. The expandable apparatus of claim 11, wherein the movable member is configured to rotate and translate relative to the at least one actuation fluid pathway to selectively place the at least one aperture in communication with the at least one actuation fluid pathway.

13. The expandable apparatus of claim 8, further comprising an actuation feature for moving the at least one member between the retracted position and the extended position.

14. The expandable apparatus of claim 13, wherein at least one actuation fluid pathway is in fluid communication with a chamber adjacent to the actuation feature, and wherein fluid supplied to the chamber through the at least one actuation fluid pathway is configured to displace the actuation feature.

15. The expandable apparatus of claim 14, wherein the actuation feature comprises a piston, wherein translation of the piston moves the at least one member between the retracted position and the extended position.

16. The expandable apparatus of claim 8, wherein the expandable apparatus comprises an expandable reamer having at least one blade with cutting elements coupled thereto for reaming a subterranean borehole.

17. A method for actuating a downhole tool, the method comprising:

inhibiting, with an actuation element, fluid flowing through a bore of the downhole tool from flowing through at least one aperture in a member of an actuation assembly in a closed position to create a force;

moving the member of the actuation assembly to an open position responsive to the force of fluid in the bore to enable fluid to flow through the at least one aperture in the member and into at least one port of the actuation assembly;

flowing fluid through the at least one port in a downhole direction to move an actuation member connected to a downhole tool;

actuating a component of the downhole tool responsive to movement of the actuation member; and releasing the actuation element in a downhole direction.

18. The method of claim 17, further comprising repeatedly moving the actuation assembly between the open position and the closed position with an actuator element retention feature.

* * * * *